US006405376B1

(12) United States Patent
Falk et al.

(10) Patent No.: US 6,405,376 B1
(45) Date of Patent: Jun. 18, 2002

(54) OUTERWEAR AND METHOD FOR MANUFACTURING OUTERWEAR

(75) Inventors: Heather D. Falk; Kenneth C. Walsh, both of Bozeman, MT (US)

(73) Assignee: Simms Fishing Products Corporation, Bozeman, MT (US)

( * ) Notice: Subject to any disclaimer, the term of this patent is extended or adjusted under 35 U.S.C. 154(b) by 0 days.

(21) Appl. No.: 09/662,184

(22) Filed: Sep. 15, 2000

(51) Int. Cl.[7] ..... A41D 13/00
(52) U.S. Cl. ..... 2/94; 2/102; 2/247
(58) Field of Search ..... 2/102, 94, 247, 2/108, 69, 79, 106, 105, 115, 85, 93, 159, 160, 249, 250, 253, 237, 241, 125

(56) References Cited

U.S. PATENT DOCUMENTS

| | | | | |
|---|---|---|---|---|
| 1,131,054 | A | 3/1915 | Glassman | |
| 1,879,341 | A | 9/1932 | Lapham | |
| 2,717,391 | A | 9/1955 | Bracken | |
| 3,130,416 | A | 4/1964 | Mitchell et al. | |
| 4,106,121 | A | 8/1978 | Belson | |
| 4,334,326 | A | 6/1982 | Mallow | |
| 4,791,681 | A | 12/1988 | Dean | |
| 5,014,359 | A | 5/1991 | Hanson | |
| 5,247,707 | A | 9/1993 | Parker et al. | |
| 5,421,032 | A | 6/1995 | Murphy | |
| 5,440,761 | A | 8/1995 | Abrams et al. | |
| 5,526,535 | A | 6/1996 | Dobrzenski | |
| 5,617,582 | A | 4/1997 | Burwell | |
| 5,829,060 | A | * 11/1998 | Falk et al. | 2/102 |

OTHER PUBLICATIONS

LL Bean–Fly Fishing 1995–Catalog, pp. 65 and 67; Goretex Wading Jacket; PVC Wading Jacket;Goretex Stowaway Raingear, 1995.*

* cited by examiner

*Primary Examiner*—Gloria M. Hale
(74) *Attorney, Agent, or Firm*—Merchant & Gould P.C.

(57) ABSTRACT

Outerwear is provided. The outerwear includes an outer shell having a neckline, a left armhole, a right armhole, a bottom edge, and being constructed so as to fit over a human chest. The outerwear includes a plurality of utility pockets for storing accessories and being attached to the outer shell. At least one of the utility pockets includes a pocket back side and a pocket front side, and the pocket back side and the outer shell form a retractor receiving area having an opening for accessing the retractor receiving area. A retractor is attached to the outerwear and is provided within the retractor receiving area. The outerwear can include left and right sleeves including breathable cuffs. A method for manufacturing outerwear is provided according to the invention.

15 Claims, 5 Drawing Sheets

OUTERWEAR AND METHOD FOR MANUFACTURING OUTERWEAR

FIELD OF THE INVENTION

The invention relates to outerwear including at least one retractor provided in a retractor receiving area under a utility pocket, and to a method for manufacturing outerwear including at least one retractor provided in a retractor receiving area under a utility pocket.

BACKGROUND OF THE INVENTION

Fishing vests have been used by fishermen for many years. Generally, fishing vests include pockets for storing fishing accessories while fishing. Exemplary pieces of equipment often used by fishermen include, for example, flies, lures, fishing line, insect repellent, matches, nippers, calipers, jackets, gloves, and the like. A fishing vest is a convenient article of clothing which allows fishermen to carry such equipment with them and use it when needed. Several United States Patents that describe fishing vests include U.S. Pat. No. 1,879,341 to Lapham, U.S. Pat. No. 5,247,707 to Parker et al., U.S. Pat. No. 5,014,359 to Hanson, U.S. Pat. No. 2,717,391 to Bracken, and U.S. Pat. No. 5,526,535 to Dobrzenski. Several catalogs showing commercially available fishing vests are available from Simms® Fishing Products, Inc. of Bozeman, Mont., and L. L. Bean® of Freeport, Me. A common feature of the fishing vests described in these publications is that they include several pockets for holding fishing accessones.

Fishing jackets are often used by fishermen when conditions merit an article of clothing providing desired warmth and/or rain protection. A fishing jacket generally includes a vest portion and sleeves extending from the vest portion. When the jacket is provided for warmth and/or rain protection, it is generally tailored to enhance warmth retention and/or rain protection. For example, the jacket can include a raised neck portion, a hood or head protection, and a tailored waste area. In general, a fishing jacket can be characterized as including pockets for storing fishing accessories while fishing.

Certain types of fishing equipment are used frequently by fishermen, and it is desirable to have such equipment easily accessible when its use is required. Exemplary types of frequently used equipment include a hemostat, a clipper, fly dressing, and the like. Rather than storing this type of equipment in pockets, it has been found to be advantageous to attach it to fishing vests using a retractor. In addition, certain types of equipment are easily dropped. When wading in a river, this may result in loss of the equipment. Accordingly, many fishermen use retractors to attach such equipment to a fishing vest to prevent loss. Many forms of retractors are commercially available. Commercially available retractors can be obtained from Simms® Fishing Products, Inc. These retractors are generally of the type having a spring provided within a rigid housing and with a clip on one end of the spring and which can be pulled out from inside the housing. The housing is attachable to a fishing vest. Fishing equipment can then be attached to the clip. Another style of commercially available retractor is sold under the name Zinger®.

A fishing vest having a retractor provided within a retractor pocket is disclosed by U.S. Pat. No. 5,829,060 to Falk et al. that issued on Nov. 3, 1998. The assignee of U.S. Pat. No. 5,829,060 is Simms Fishing Products, Inc., the assignee of the above-identified patent application. The entire disclosure of U.S. Pat. No. 5,829,060 is incorporated herein by reference.

SUMMARY OF THE INVENTION

Outerwear is provided according to the invention. The outerwear includes an outer shell having a neckline, a left armhole, a right armhole, a bottom edge, and is constructed to fit over a human chest. The outerwear includes a plurality of utility pockets attached to the outer shell. The utility pockets are provided for storing accessories. At least one of the utility pockets includes a pocket back side and a pocket front side. The pocket backside and the outer shell form a retractor receiving area having an opening for accessing the retractor receiving area. A retractor is attached to the outerwear, and the retractor is provided within the retractor receiving area.

Outerwear in the form of a jacket having left and right sleeves and breathable cuffs at the wrist areas of the sleeves is provided according to the invention. The breathable cuffs include a combination of a stretch material that provides at least about 10% elongation, and a waterproof and breathable material that provides 1,000 mm or more of water resistance in the Suter test and 0 to 60 resistance to evaporative transpiration according to the Hohenstein Institute. The combination of stretch fabric and waterproof and breathable material can be provided as a laminate or as a coating, and the waterproof and breathable material can be provided as a membrane. The stretch material preferably wraps the wearer's wrist and provides pressure on the wearer's wrist. The breathable cuff can additionally include a band for tightening the fit of the stretch material against the wearer's wrist.

A method for manufacturing outerwear is provided according to the invention. The method includes a step of attaching a utility pocket to the outer shell of outerwear to provide a retractor receiving area between the outer shell and the utility pocket and having an opening for accessing the retractor receiving area, and attaching a retractor to the outerwear so that the retractor is provided within the retractor receiving area.

BRIEF DESCRIPTION OF THE DRAWINGS

The following is a brief description of the drawings showing various features of the present invention.

DETAILED DESCRIPTION OF THE PREFERRED EMBODIMENT

Figure 1:
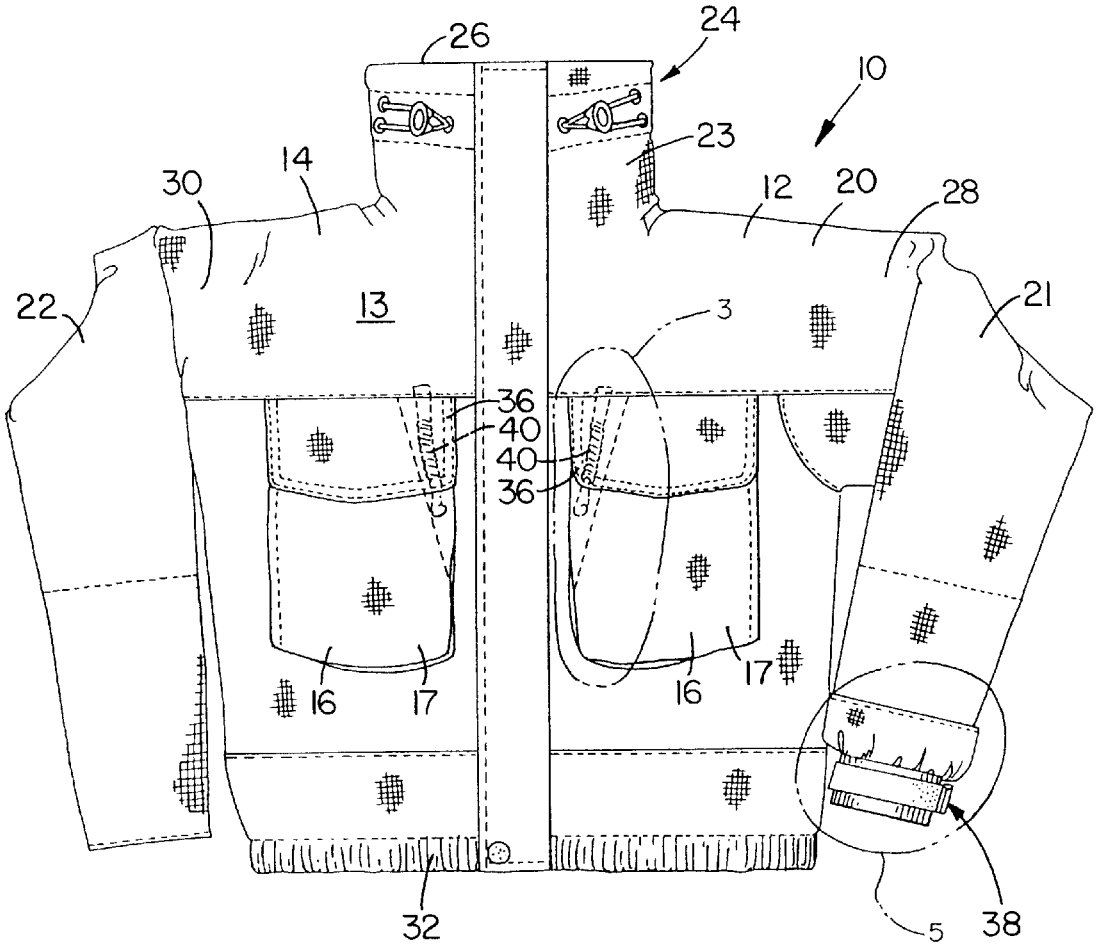
FIG. 1 is a front view of outerwear according to the principles of the present invention.

Referring to FIG. 1, outerwear according to the principles of the present invention is depicted at reference numeral 10. The outerwear 10 is shown as a fishing jacket 12. The outerwear 10 includes an outer shell 14 that generally forms the exterior 13 of the jacket, and utility pockets 16. The utility pockets 16 can be referred to as fishing accessory pockets 17 when they are sized for holding fishing-related accessories such as fly boxes. The outerwear 10 generally fits around the chest of a wearer. That is, part of the outerwear 10 extends over the shoulders and around the neck, and part of the outerwear 10 extends around the back of a wearer and across the chest. The utility pockets 16 are attached to the outer shell 14. The outerwear 10 can include interior fabrics and/or insulation such as that commonly found on commercially available outerwear. In addition, the outer shell 14 can provide water resistance so that it can be characterized as a rain jacket. In addition, the outerwear 10 can include a wind barrier layer so that it can be characterized as a wind shell, and the outerwear 10 can include insulation so that it can be characterized as an insulating jacket.

The outerwear 10 includes a vest portion 20, a left sleeve 21, a right sleeve 22, a neck area 23, and a hood 24. The outer shell 14 includes a neckline 26, a left armhole 28, a right armhole 30, and a bottom edge 32.

The outerwear 10 includes utility pockets 16 and retractor receiving areas 36. The retractor receiving areas 36 are provided between the utility pockets 16 and the outer shell 14. Preferably, the retractor receiving areas 36 are relatively hidden from view when looking at the outerwear from the front as provided in FIG. 1. In addition, the outerwear 10, when provided as a jacket having left sleeve 21 and right sleeve 22, can include a breathable cuff 38 on each sleeve. The breathable cuff 38 preferably provides resistance to the passage of liquid water into the sleeve when the breathable cuff 38 is tightened around the wearer's wrist, but allows passage of air and water vapor out of the sleeve.

Figures 2, 3:
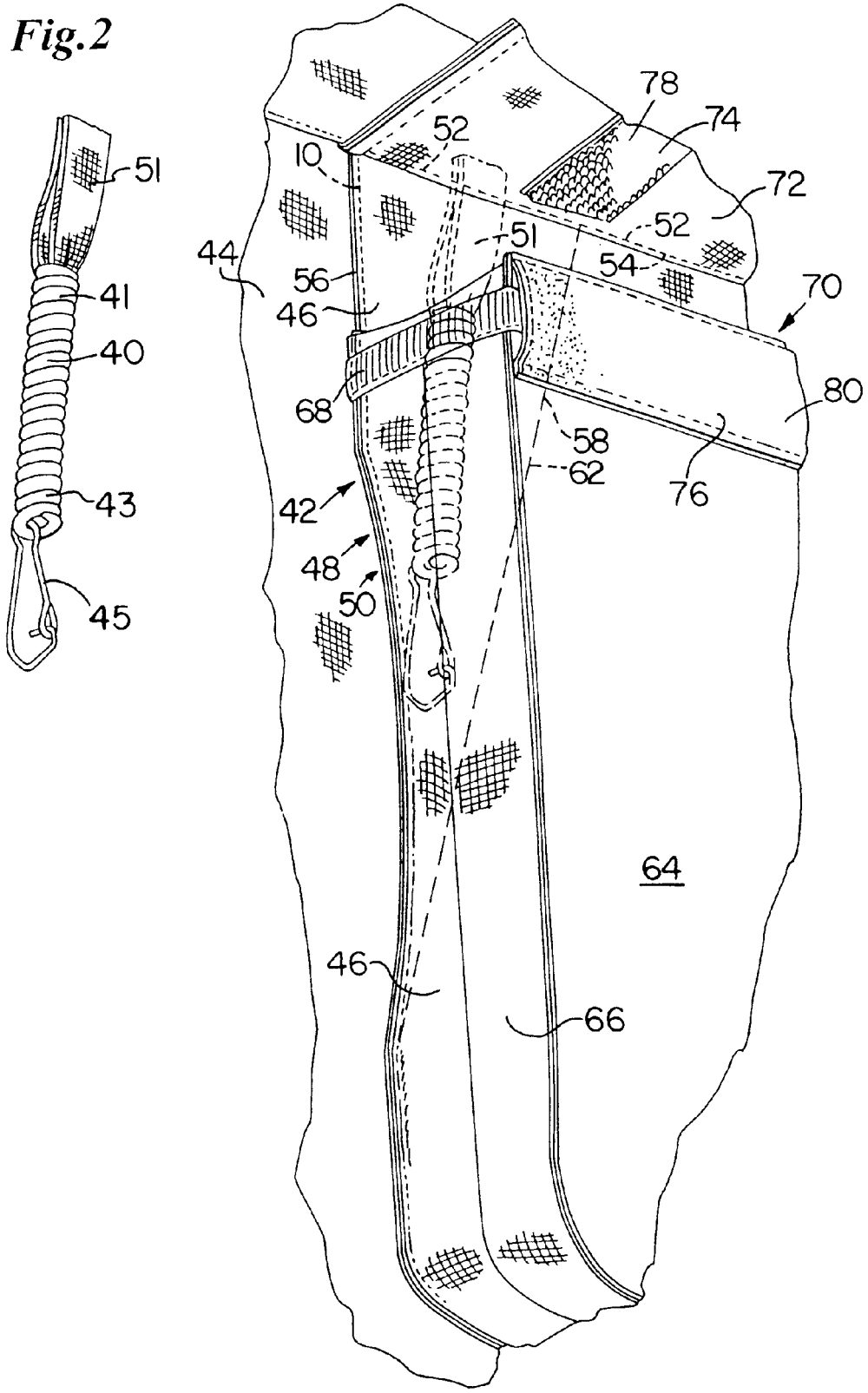
FIG. 2 is a perspective view of the retractor shown in FIG. 1.
FIG. 3 is a perspective view of the retractor receiving area shown in FIG. 1 wherein the retractor is provided in a relaxed position.
Figure 4:
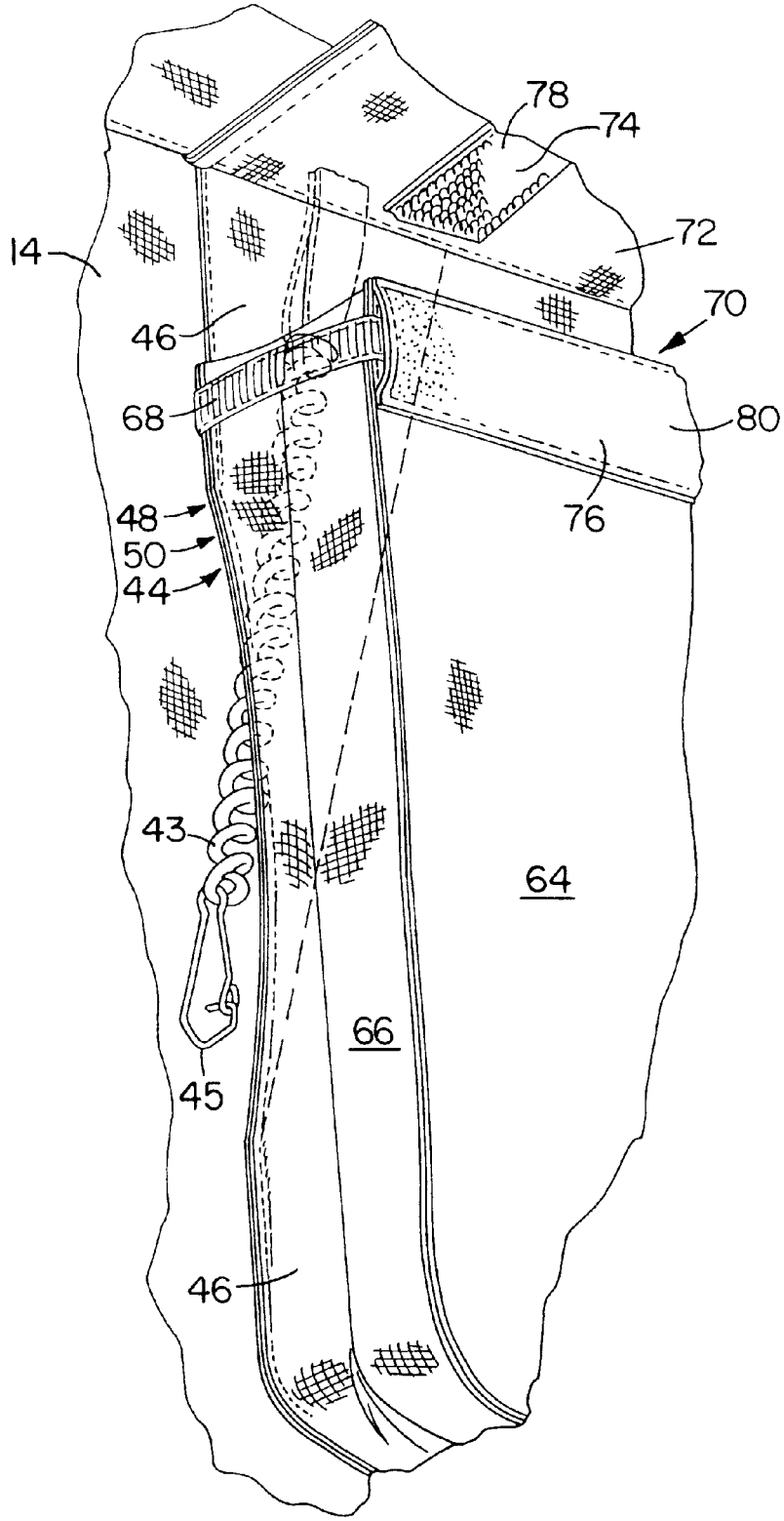
FIG. 4 is a perspective view of the retractor receiving area shown in FIG. 1 wherein the retractor is provided in an extended position.

Now referring to FIGS. 2–4, retractors 40 are shown provided within the retractor receiving areas 36. The retractor 40 is provided in a relaxed position 42 in FIG. 3, and is provided in an extended position 44 in FIG. 4.

The retractor receiving areas 36 are preferably formed between the outer shell 14 and the utility pocket back side 46. Accordingly, the outer shell 14 and the utility pocket back side 46 can provide a retractor receiving area interior 48 that contains the retractor 40 and generally prevents the retractor 40 from falling away from or extending away from the outerwear 10 as the wearer bends over. That is, the retractor receiving areas 36 keep the retractor 40 and accessories attached to the retractors close to the wearer's body.

The retractor receiving areas 36 are preferably provided with an opening 50 for accessing the retractor receiving areas 36. The openings are preferably provided so that the retractor can be accessed but that the retractor is provided within an enclosure that keeps the retractor from falling away from the outerwear. The opening can be provided so that it faces or opens downwardly when the outerwear 10 is worn by a person standing in an upright position. By facing or opening downwardly, it is meant that the pocket is provided in a configuration which would cause items placed loosely therein to fall out under the force of gravity when the outer wear is worn by a person standing in an upright position. It should be understood that the retractor receiving areas according to the invention are not required to have only one opening. The retractor receiving areas can have two or more openings.

The retractor 40 preferably includes a tab 51 for holding the retractor 40 in place. The tab 51 is preferably attached at the seam 52 provided between the outer shell 14 and the utility pocket backside 46. Preferably, the seam 52 is provided by stitch line 54. It should be understood that the retractor 40 could be attached to the outerwear 10 so that it is provided within the retractor receiving area 34 without the use of a tab 51. The retractor receiving area 36 is preferably formed by seams 56 and 58 provided between the outer shell 14 and the utility pocket back side 46. The seams 56 and 58 are preferably stitch lines 60 and 62.

The retractor 40 is preferably provided as a spring that moves between a relaxed position 42 and an extended position 44. The retractor 40 includes a first end 41 that attaches to the tab 51, and a second end 43 that attaches to a clip 45. The first end 41 can be attached directly to the outerwear 10 without the use of the tab 51. The clip 45 is provided for attaching the retractor 40 to various accessories. Preferably, the retractor 40 is formed from a polyurethane material. An additional type of retractor that can be used according to the invention includes a spring loaded spool retractor. In general, this type of retractor includes a spool around which a string is wound, and the spool and string are provided within a housing and a spring biases the retractor in a retracted position. An end of the string outside of the housing can include a clip for attachment to various accessories, and the string can be pulled out of the housing and then retracted into the housing. A retractor of this type is available under the name Zinger®.

An advantage of the retractor receiving area 36 according to the invention is that it holds the retractor 40 and the accessory attached to the retractor 40 closer to the chest of the wearer. This is particularly important when the wearer bends over. Prior retractors tend to fall away from the wearer's chest when the wearer bends over. This dangling of retractor and accessory away from the wearer's chest creates problems and can cause frustration when it becomes entangled with, for example, a fishing line. The retractor receiving area of the present invention keeps the retractor and accessory held closely to the body in order to avoid this problem. In addition, the placement of the retractor receiving area underneath a utility pocket hides the appearance of the retractor receiving area. A retractor pocket is disclosed by U.S. Pat. No. 5,829,060 to Falk et al.

The utility pockets 34 are preferably formed by the utility pocket backside 46 and a utility pocket front side 64. Sides 66 can be provided extending between the utility pocket back side 46 and the utility pocket front side 64. Preferably, an elastic band 68 is provided for holding the utility pocket front side 64 close to the utility pocket backside 46 and for closing the opening 70 of the utility pocket 34. The utility pocket can include a flap 72 for covering the opening 70. The flap 72 can include a fastener 74 which engages a fastener 76 on the utility pocket 34. Preferably, the fasteners 74 and 76 are hook and loop fasteners 78 and 80.

Figure 5:
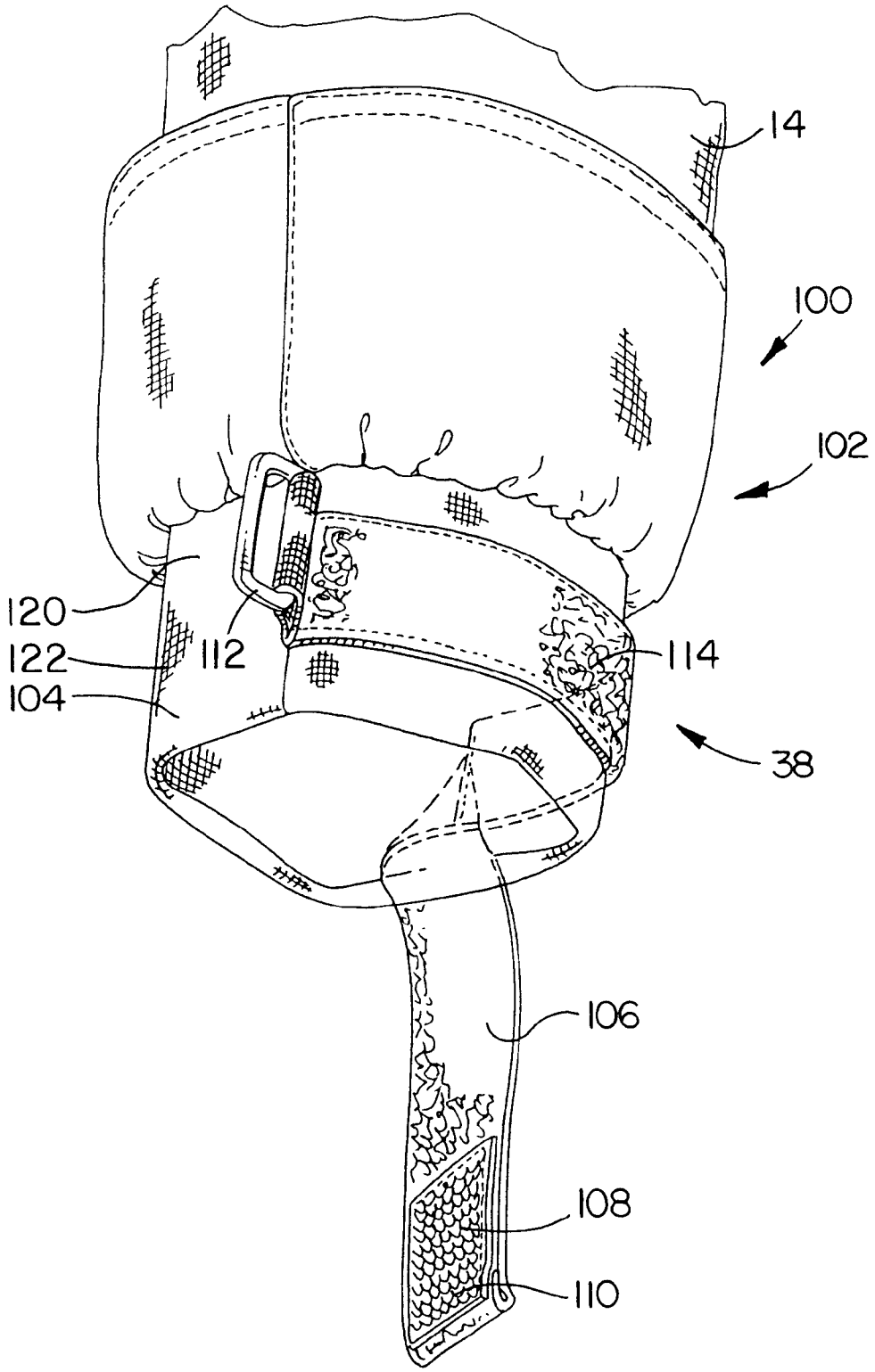
FIG. 5 is a perspective view of the cuff of the outerwear shown in FIG. 1.
Figure 6:
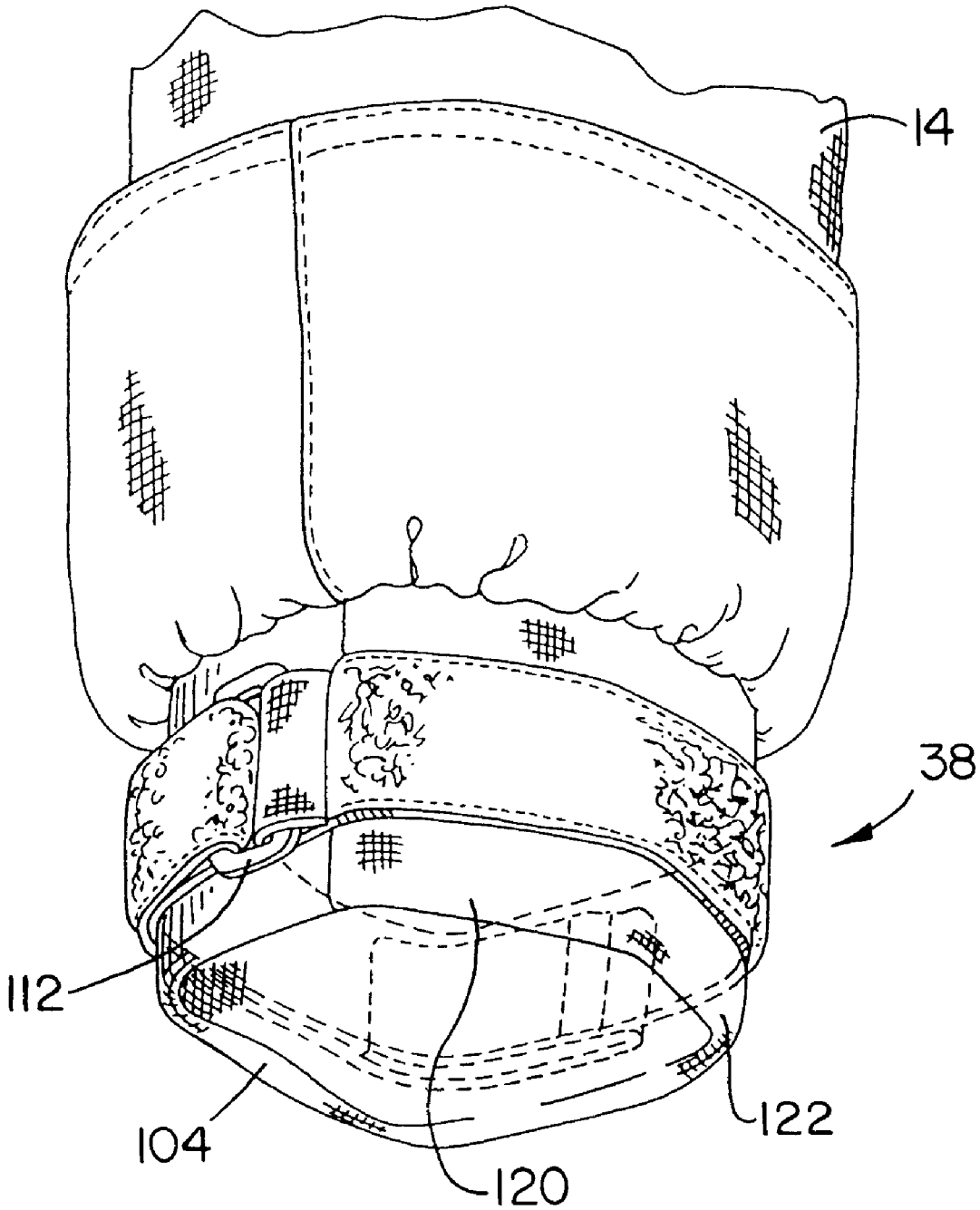
FIG. 6 is a perspective view of the cuff of the fishing jacket shown in FIG. 1.

Now referring to FIGS. 5 and 6, the breathable cuff 38 is shown with the outer shell 14 rolled back to form a cuff 100 at the wrist region 102. The breathable cuff 38 includes a stretch material 104 that wraps the wearer's wrist and preferably provides slight pressure on the wearer's wrist. A band 106 can be provided wrapping the stretch material 104 to provide adjustable tension against the wearer's wrist. Preferably, the band 106 includes a fastener 108 that is preferably a hook and loop fastener 110 to provide adjustable tension when threaded through the loop 112 and fastened to the backside 114 of the band 106. Alternative fasteners that can be used are plastic buckle type fasteners that are commercially available from ITW Nexus, TIFCO, NIFCO, and National Molding. In general, these types of fasteners include a male and female side, and have webbing passing therethrough.

The stretch material 104 is preferably a material that resists the passage of liquid waters therethrough, but allows air and water vapor to pass therethrough. The stretch material is preferably a stretchable fabric 120 having a waterproof and breathable material 122 provided thereon. The stretchable fabric 120 and the waterproof and breathable material 122 can be laminated together or provided as a coating. The stretch fabric 120 is preferably a material that provides at least 10% stretch as measured as a percentage of elongation. The waterproof and breathable material preferably exhibits sufficient waterproofness that it is capable of withstanding 1,000 mm or more of water resistance in the Suter test. By breathability, it is meant that it is capable of providing from 0 to 60 RET (resistance to evaporative transpiration) as defined by Hohenstein Institute in the "extremely breathable range." The waterproof and breathable material is preferably a laminate or coating. Exemplary materials that can provide the membrane or coating include expanded PTFE (polytetrafluoroethylene), polyurethane, foamed polyurethane, and polyester. An exemplary expanded PTFE material is available under the name Gore-tex® from Gore. A preferred stretch material 104 is available as consumer stretch Gore-tex® from Gore. An exemplary polyester material is available under the name Hytrel® from DuPont. Preferably, the waterproof and breathable material 122 is a membrane of expanded polytetrafluoroethylene (PTFE) material.

When the outerwear 10 is provided as a rain jacket, it is desirable for the outerwear to include an outer material 130 that resists passage of liquid water therethrough but allows air to pass therethrough. Preferred materials can be referred to as stretched PTFE membranes and are available under the name Gore-tex® from Gore.

Although the invention has been shown and described with respect to certain preferred embodiments, certain variations and modifications may occur to those skilled in the art, and such variations and modifications should be considered within the scope of the invention.

We claim:

1. Outerwear comprising:

(a) outer shell having a neckline, a left armhole, a right armhole, a bottom edge, and being constructed to fit over a human chest;

(b) plurality of utility pockets for storing accessories, the plurality of utility pockets being attached to the outer shell;

(i) at least one of the plurality of utility pockets comprising a pocket backside and a pocket front side;

(ii) the pocket back side and the outer shell forming a retractor receiving area having an opening for accessing the retractor receiving area; and (c) retractor provided within the retractor receiving area.

2. Outerwear according to claim 1, wherein the retractor comprises a spring having a first end attached to the outerwear and a second end attached to a clip for holding accessories.

3. Outerwear according to claim 2, wherein the first end of the retractor is attached to a tab that is attached to the outer shell.

4. Outerwear according to claim 1, wherein the retractor comprises a spring formed from a polyurethane material.

5. Outerwear according to claim 1, wherein the pocket back side is sewn to the outer shell to provide the retractor receiving area.

6. Outerwear according to claim 1, comprising at least two utility pockets attached to the outer shell and forming at least two retractor receiving areas.

7. Outerwear according to claim 1, wherein the outer shell comprises a left sleeve having a breathable cuff and a right sleeve having a breathable cuff, wherein the breathable cuffs include a stretch fabric and a membrane material, the stretch fabric provided for applying pressure on the wrist of a wearer.

8. Outerwear according to claim 7, wherein the breathable cuffs further comprise a band for controlling the pressure applied by the breathable cuff against the wearer's wrist.

9. Outerwear according to claim 7, wherein the membrane material comprises polytetrafluoroethylene material.

10. A method for manufacturing outerwear, the method comprising:

(a) attaching a utility pocket to an outer shell of outerwear to form a retractor receiving area between the utility pocket and the outer shell, wherein the retractor receiving area has an opening for accessing the retractor receiving area; and (b) attaching a retractor to the outerwear so that the retractor is provided within the retractor receiving area.

11. A method according to claim 10, wherein the retractor comprises a spring having a first end attached to the outerwear and a second end attached to a clip for holding accessories.

12. A method according to claim 10, wherein the first end of the retractor is attached to a tab that is attached to the outer shell.

13. A method according to claim 10, wherein the retractor comprises a spring formed from a polyurethane material.

14. A method according to claim 10, wherein the pocket back side is sewn to the outer shell to provide the retractor receiving area.

15. A method according to claim 10, comprising at least two utility pockets attached to the outer shell and forming at least two retractor receiving areas.

* * * * *